US005682588A

United States Patent [19]

Tsutsui et al.

[11] Patent Number: 5,682,588

[45] Date of Patent: Oct. 28, 1997

[54] METHOD FOR PRODUCING FERROUS SINTERED ALLOY HAVING QUENCHED STRUCTURE

[75] Inventors: Tadayuki Tsutsui, Matsudo; Kei Ishii, Kashiwa; Hideo Shikata, Matsudo; Sumihisa Kotani, Hitachinaka, all of Japan

[73] Assignees: Hitachi Powdered Metals Co., Ltd., Chiba; Hitachi Koki Co., Ltd., Tokyo, both of Japan

[21] Appl. No.: 716,744

[22] Filed: Sep. 23, 1996

[30] Foreign Application Priority Data

Sep. 27, 1995 [JP] Japan ..... 7-273403

[51] Int. Cl.[6] ..... B22F 3/12

[52] U.S. Cl. ..... 419/11; 419/25; 419/38; 419/46; 75/246

[58] Field of Search ..... 419/11, 25, 38, 419/46; 75/243, 246

[56] References Cited

U.S. PATENT DOCUMENTS 5,458,670 10/1995 Ogura et al. ..... 75/252
5,476,534 12/1995 Ogura et al. ..... 75/252
5,476,632 12/1995 Shivanath et al. ..... 429/57
5,489,324 2/1996 Takahashi et al. ..... 75/246

*Primary Examiner*—Charles T. Jordan
*Assistant Examiner*—Daniel Jenkins
*Attorney, Agent, or Firm*—Birch, Stewart, Kolasch & Birch, LLP

[57] ABSTRACT

The present invention relates to a method for producing, without quench-hardening process, a ferrous sintered alloy having satisfactory strength which is equal to that of the conventional ferrous sintered quenched material, and the method comprises the steps of: preparing a powder mixture by adding, in weight ratios, 1 to 2% of copper powder, 1 to 3% of Ni powder, and graphite to a ferrous alloy powder consisting of 3 to 5% of Ni, 0.4 to 0.7% of Mo, and the remainder Fe, the quantity of said graphite being determined such that the C-content after sintering is 0.2 to 0.7%; compacting said powder mixture in a tool to form a green compact; sintering said green compact in a non-oxidizing atmosphere at a temperature in the range of 1130° to 1230° C.; and cooling the sintered product in the sintering furnace at a rate of 5° C./min. to 20° C./min.

3 Claims, 3 Drawing Sheets

| Sample number | No. 1 | No. 2 | No. 3 | No. 4 | No. 5 | No. 10 | No. 11 |
|---|---|---|---|---|---|---|---|
| Ni-content (%) in alloy powder | 0 | 1 | 2 | 3 | 4 | 5 | 6 |
| Ni element powder (%) | 6 | 5 | 4 | 3 | 2 | 1 | 0 |

Cu element powder: 1.0% constant; C (graphite): 0.5% after sintering

| Sample number | No. 1 | No. 2 | No. 3 | No. 4 | No. 5 | No. 10 | No. 11 |
|---|---|---|---|---|---|---|---|
| -content (%) alloy powder | 0 | 1 | 2 | 3 | 4 | 5 | 6 |
| nt powder (%) | 6 | 5 | 4 | 3 | 2 | 1 | 0 |

t powder: 1.0% constant; whole composition: Fe-6%Ni-1%Cu-0.5%Mo-0.5%C

Ni element powder: 2% constant, Cu element powder: 1% constant
C (graphite): 0.5% after sintering Ni element powder: 2% constant, Cu element powder: 1% constant
C (graphite): 0.5% after sintering Material: Sample No. 5, Fe-6%Ni-1%Cu-0.5%Mo-0.5%C

METHOD FOR PRODUCING FERROUS SINTERED ALLOY HAVING QUENCHED STRUCTURE

BACKGROUND OF THE INVENTION

1. Field of the Invention

The present invention relates to powder metallurgy and particularly to a method for producing a ferrous sintered alloy having an excellent strength, which alloy can be made without any quench-hardening treatment.

2. Prior Art

Because of the characteristic advantage in the cost efficiency of ferrous sintered alloys manufactured in accordance with the powder metallurgical method, the ferrous sintered alloy parts are widely employed in the fields of, for example, automobiles, machine tools, household electrical appliances and so forth. Even in the circumstances like this, however, the reduction of production cost is required also in sintered metal parts in order to cope with the recent tendency toward the lowering of prices of a variety of industrial products.

In order to meet the above needs, inexpensive iron powder or the like materials are being developed. There is, however, a problem that characteristics of materials are degraded. Furthermore, the cost reduction is intended by employing continuous and automated manufacturing process or robotized process, but any satisfactory result has not yet been attained in this respect.

In powder metallurgical parts of which high strength is required, treatment of hardening is applied to the obtained parts after the compacting and sintering step. If a product having better characteristics as compared with those of conventional ferrous sintered products is obtained without employing the quench-hardening step, it may be possible to reduce the production costs largely. In addition to this, it is also possible to avoid the decrease in dimensional precision which is caused to occur in the quenching step. As a measure to obtain high-strength parts without employing the quenching step, there is proposed a method for producing sintered parts in which an alloy powder of a good hardening property is used and the sintered material is subjecting to martensitic transformation at the cooling rate of sintering. However, the cooling rate in an ordinary sintering furnace is 5° to 20° C./min., and for obtaining a martensitic structure at this cooling temperature, the amount of alloy elements must be increased inevitably, which results in the lowering of compressibility markedly. As a consequence, the strength of obtained material is lower than that of a conventional ferrous sintered quenched material.

Meanwhile, the material which is prepared by adding the powder of Ni, Cu, or Mo to improve the hardenability, to a pure iron powder or diffusion bonded powder which is prepared from the these raw materials, is excellent in compressibility. However, because the alloy components in the sintered products of these materials are uneven, only a part of the micro structure is changed into a martensitic structure. In this case, however, for changing the micro structure into the martensitic structure as much as 85% or more, it is necessary to sinter the raw material at a temperature above 1250° C. so as to diffuse the added elements. Thus, problems are brought about not only in that the cost for sintering process is raised with the economical disadvantage but also in that the dimensional accuracy is not satisfactory.

BRIEF SUMMARY OF THE INVENTION

The present invention has been accomplished in view of the above-described status of art.

It is, therefore, the object of the present invention to provide a novel method for producing, without quenching, a ferrous sintered alloy having strength which can be compared with those of the conventional ferrous sintered quenched materials.

In order to attain the above object, a variety of studies has been carried out for improving the hardenability and minimizing the lowering of compressibility of ferrous sintered alloy to be produced.

As a result, the present inventors have found out that an improved ferrous sintered alloy can be prepared by adding the powder of single element to improve hardenability to an alloy powder which has the compressibility equal to that of the conventional ferrous sintered material. In this invention, the lowering of strength due to the lowering of compressibility is suppressed and 85% or more of micro structure is transformed into martensitic phase with the remainder of bainitic phase at a cooling rate of 5° to 20° C./min. in an ordinary sintering furnace. More specifically, the method for producing a ferrous sintered alloy according to the present invention is characterized by the steps of compacting in a tool a mixed powder prepared by adding 1 to 2% of copper powder, 1 to 3% of Ni powder, and graphite in such an amount that the C-content after sintering is 0.2 to 0.7% to an alloy powder composition consisting of 3 to 5% of Ni, 0.4 to 0.7% of Mo, and the remainder Fe to form a green compact; sintering the green compact in a non-oxidizing atmosphere at a temperature within the range of 1130° to 1230° C.; and cooling the sintered product in the sintering furnace at a rate in the range of from 5° C./min. to 20° C./min. It is to be noted that the percentage (%) herein used are "percent by weight" unless otherwise expressed.

BRIEF DESCRIPTION OF THE DRAWINGS

The present invention will become more fully understood from the detailed description given hereinafter and the accompanying drawings which are given by way of illustration only, and they are not limitative of the present invention, wherein.

DETAILED DESCRIPTION OF THE INVENTION

Figure 1:
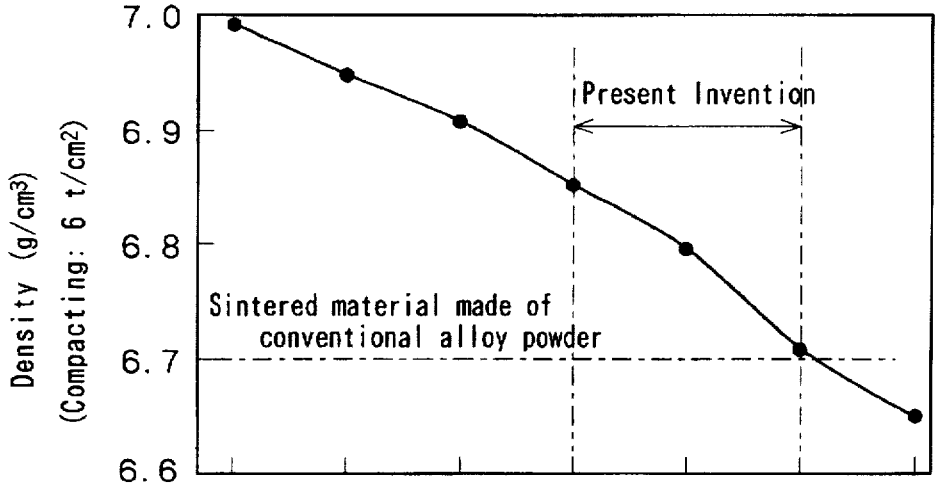
FIG. 1 is a graphical representation showing the relationship between compositions of ferrous alloy powders and compressibilities (densities) of powder mixtures.

When an alloy powder is used as the principal component of a mixed powder and an element or elements improving hardenability are added singly, it is easier to obtain a sintered alloy having a high compressibility and a high density in comparison with the use of a wholly alloyed powder. However, when the content of alloy elements in a ferrous alloy powder is less than the prescribed amount or when Ni powder, Mo powder, and Cu powder are added to pure iron powder so as to obtain prescribed composition of a sintered alloy, it is difficult to obtain a sintered alloy having the aimed quenched structure.

As the alloy elements to be added to the ferrous alloy powder, Ni and Mo are preferable which are effective in improving the hardenability and which hardly worsen the compressibility. The contents of them to be added depend upon the hardenability and the compressibility of material. With 3 to 5% of Ni and 0.4 to 0.7% of Mo, a product which has a higher compressibility as compared with the product of the conventional alloy powder of 6.7 g/cm$^3$ or more in green density at 6 t/cm$^2$ in compacting pressure, can be obtained. When the quantity of the alloy elements exceeds the above described range, the compressibility and the strength of material become worse. On the contrary, when the content of the alloy elements is less than the above described lower limit, it is not possible to transform 85% or more of micro structure into martensitic phase even when the powder of a single element for improving hardenability is added, so that the strength of material is lowered.

When only the graphite is added to this alloy powder, only the bainitic structure is obtained. It is necessary to improve further the hardenability in order to form more than 85% of martensitic phase, so that it is required to add the element for improving hardenability. Such elements are exemplified by Cu, Ni, Mn, and Cr. In view of the sintering property, Cu and Ni are effective to improve the hardenability. If the amount of Cu added is less than 1%, its effect is not recognized. On the other hand, if it exceeds 2%, the impact resistance is lowered. Accordingly, the addition quantity of Cu is specified within the range of 1 to 2%. Furthermore, Ni has an effect to suppress the embrittlement due to Cu in addition to the effect to improve hardenability. When the addition quantity of Ni is less than 1%, its effect cannot be recognized, while if it exceeds 3%, the martensitic phase is rather decreased because of the existence of austenitic phase in which Ni is concentrated and there occurs a tendency of the lowering of strength, so that it is preferred to specify the value of Ni within the range of 1 to 3%.

A cooling rate in the sintering step is determined by a CCT (continuous cooling transformation) diagram of the material. It is specified as a value 5° C./min. or higher so that the martensite phase occupies 85% or more of the grain structure in an area ratio. If the cooling rate exceeds 20° C./min., an additional cooling device is required which increases the cost for sintering, so that the appropriate value of cooling rate is preferred in the range of from 5° C./min. to 20° C./min.

Although there are several measures to add carbon (C) such as the addition in the form of graphite and with the use of carburizing gas in a sintering atmosphere, it is necessary for adding the carbon as graphite in order to obtain a uniform martensitic structure throughout the material. The quantity of graphite to be added is determined such that the C-content after sintering is within the range of from 0.2 to 0.7%. If the C-content after sintering is less than 0.2%, it is impossible to obtain 85% of martensite in the area ratio of the sintered alloy, while if it exceeds 0.7%, remaining austenite phase increases, and further cementite precipitates along the grain boundaries resulting in the lowering of strength. Therefore, the content of C after sintering must be within the range of from 0.2 to 0.7%.

Because the sintering operation is carried out after the addition of graphite, the content of C after the sintering decreases to some extent in comparison with the quantity before the sintering. The actual addition quantity of graphite was 0.4 to 0.8% in the case of the reducing atmosphere with dissociated ammonia gas that was carried out by the present inventors. The decrease of C-content depends upon the used powder, sintering conditions and so forth, it is necessary to confirm the preferable quantity by means of experiments, with calculating the addition quantity in view of an aimed content of C.

In 100% of sintered structure other than the pores, if 85% to 97% of structure is a martensitic phase and the remainder is a bainitic structure, the strength of the sintered alloy is equal to that of conventional ferrous sintered material which was prepared with quenching treatment. In addition, because 3% or more bainitic structure is dispersed, the material excels in toughness. However, when the area ratio of bainitic structure exceeds 15%, the strength of the resulting ferrous sintered alloy decreases. Accordingly, the area ratio is kept within the range of 3% to 15%.

Moreover, when a sintered material is maintained at a temperature within the range of 150° C. to 300° C., martensitic structure is converted into tempered martensite to raise the toughness, so that the strength of the material is further improved. Furthermore, because the structure is stabilized, it is possible to produce the effect to suppress changes, particularly the change in dimensions with the passage of time. As the measure to maintain the temperature in the range of 150° C. to 300° C., there is a method in which the material after sintering is once cooled to the room temperature, and it is then heated again in a tempering furnace. In another method, the sintered material is cooled not to room temperature but to about 100° C. and it is transferred into a tempering furnace to be reheated, so that the saving of energy consumption can be attained. Moreover, in certain sintering heat patterns, the temperature of materials is directly changed into the range of 150° C. to 300° C. without cooling the sintering furnace below 100° C., thus the isothermal transformation is accelerated, remained austenite is transformed into bainite, and the martensite is tempered to give high toughness. According to the method described above, it is possible to achieve the cost reduction with the cutting down of process steps.

The time for maintaining materials in the above described temperature range is preferably from the maximum thickness (mm)×0.05 to 0.10 hours or so.

In summary, as described above, the present invention is characterized by the steps of: compacting a powder mixture prepared by incorporating specified quantities of Ni powder, Cu powder, and graphite powder with a ferrous alloy powder containing Ni and Mo in a specific composition to form a green compact; sintering the thus obtained green compact at a temperature in the range of 1130° to 1230° C.; and cooling the sintered product in the sintering furnace at a specific cooling rate, thereby obtaining a ferrous sintered alloy which is excellent in strength and which has a specific quenched structure.

The present invention will now be described in more detail with reference to several examples, in which the percentages and ratios of the component materials are those on weight bases unless otherwise indicated.

EXAMPLE 1

To each of Fe—Ni—Mo alloy powders of 11 kind chemical compositions shown in Table 1, was added 1% of copper powder and Ni powder. The quantity of Ni powder was so determined that the total Ni content was 6%. Then, graphite powder was added in the amount that the C-content after sintering was adjusted to 0.5%. Furthermore, 0.8% of zinc stearate powder was added as a lubricant, and they were mixed together for 30 minutes.

Figure 2:
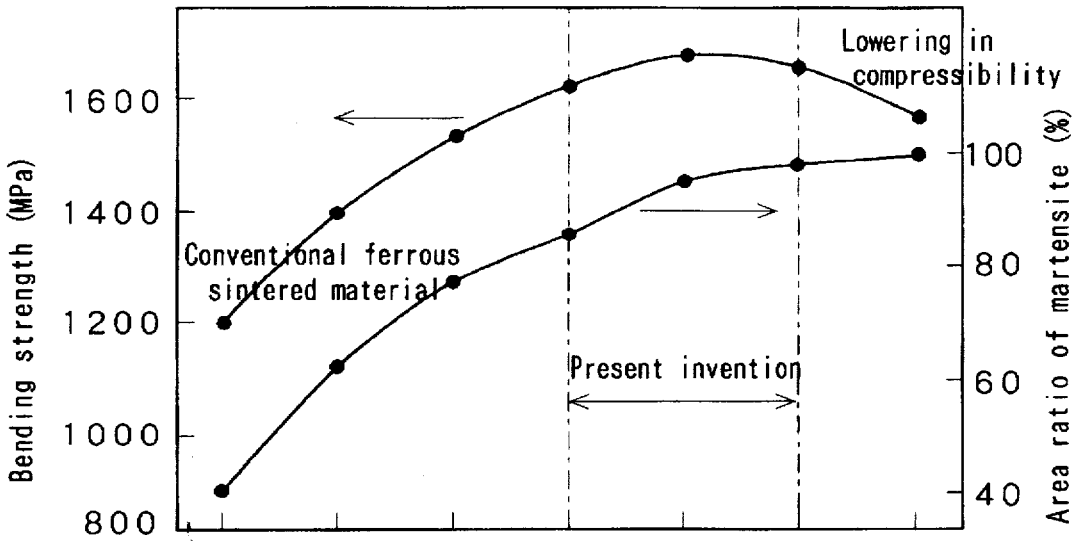
FIG. 2 is a graphical representation showing the influence of the types of ferrous alloy powder and the addition quantities of Ni powder upon the bending strengths of sintered materials and the amounts of martensite in the micro structures.
Figure 3:
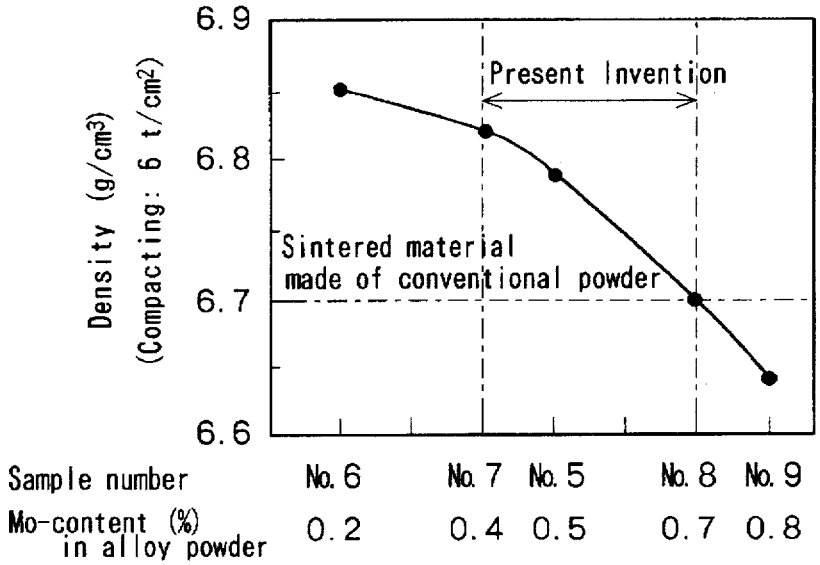
FIG. 3 is a graphical representation showing the relationship between Mo contents of ferrous alloy powders and compressibilities (densities) of mixed powders.
Figure 4:
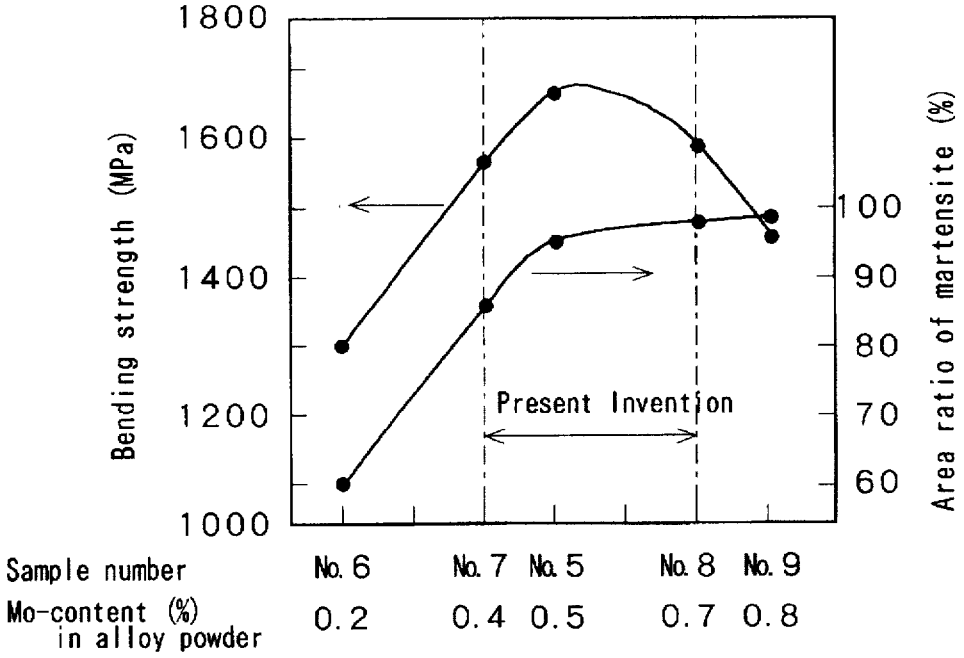
FIG. 4 is a graphical representation showing the relationship among Mo contents in ferrous alloy powders, bending strengths of sintered materials and amounts of martensite in the micro structures.

The respective powder mixtures were subjected to compacting at 600 MPa. The densities of obtained green compacts are shown in FIGS. 1 and 3. Furthermore, the area ratios of martensitic phase in micro structures and the bending strengths of sintered products which were obtained by sintering in dissociated ammonia gas at 1200° C. for 60 minutes and then cooled at a rate of 10° C./min., are shown in FIGS. 2 and 4.

As is apparent from the above described results, the compressibilities of Sample No. 4, No. 5, No. 7, No. 8, and No. 10 of the sintered materials of the present invention are superior to those of the sintered materials prepared from the conventional alloy powders. Furthermore, because the area ratios of martensitic phase in the Samples of the present invention are high, sintered metal products of high strength can be produced.

TABLE 1

| Sample No. | Ni (%) | Mo (%) |
|---|---|---|
| 1 | 0 | 0.5 |
| 2 | 1 | 0.5 |
| 3 | 2 | 0.5 |
| 4 | 3 | 0.5 |
| 5 | 4 | 0.5 |
| 6 | 4 | 0.2 |
| 7 | 4 | 0.4 |
| 8 | 4 | 0.7 |
| 9 | 4 | 0.8 |
| 10 | 5 | 0.5 |
| 11 | 6 | 0.5 |

Note: Underlined Sample Nos. are test examples according to the present invention and the others are comparative examples.

EXAMPLE 2

To the Fe—Ni—Mo alloy powder of Sample No. 5 in Example 1 was added 1% of copper powder, graphite powder and Ni powder. The quantity of Ni powder was so determined that the total Ni content was 6%. The quantity of graphite powder was such that the C-content after sintering was 0.5%. Furthermore, by adding 0.8% of zinc stearate powder as a lubricant, they were mixed together for 30 minutes.

The mixed powder was then subjected to compacting at 600 MPa to form green compacts, and they were sintered in dissociated ammonia gas at 1200° C. for 60 minutes. The sintered products were cooled at varied cooling rates of 3°, 6°, 10°, and 25° C./min. so as to obtain the products with varied area ratios of martensite. The bending strengths and impact values of the thus obtained products were measured, the results of which are shown in FIG. 5.

Figure 5:
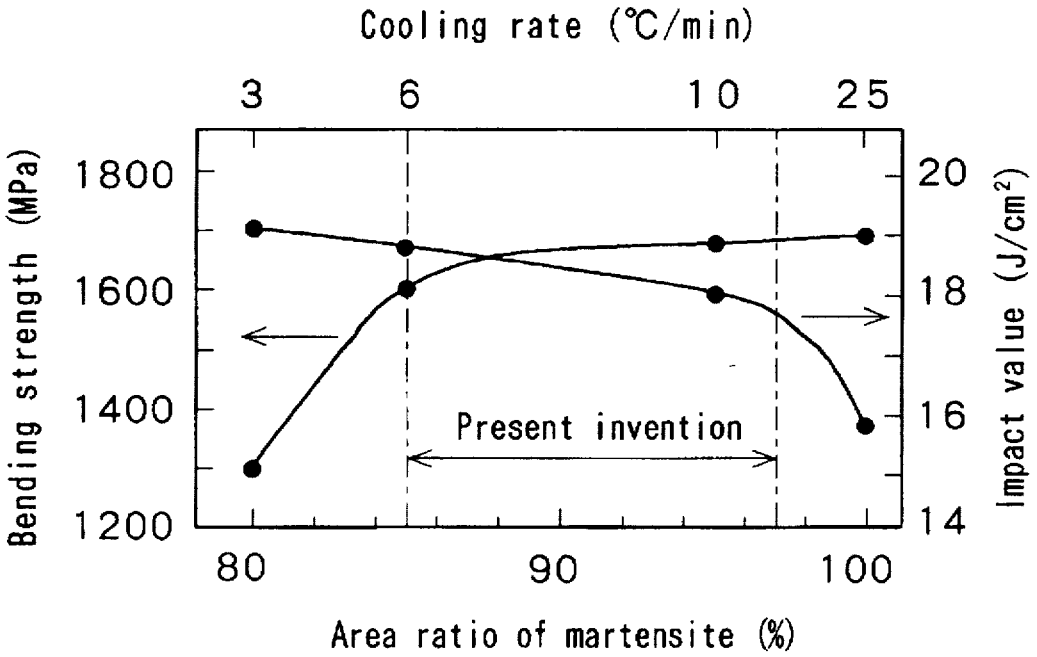
FIG. 5 is a graphical representation showing the relationship among the amounts of martensite in the structures of sintered material and the bending strengths and impact values.

As will be understood in view of FIG. 5, if the area ratio of martensite is higher, the bending strength are also higher, however, even when the area ratio is raised to 85% or more, the bending strength is not increased so much. On the other hand, the impact value is lowered with the raise of area ratio of martensite. Because in the sintered material according to the present invention, the portion other than martensitic phase is composed of bainitic phase, it is excellent in strength and toughness. In a material with 80% area ratio of martensite, however, perlitic phase is observed, the bending strength of which is low. Consequently, in the sintered material according to the present invention, the area ratio of martensitic phase is in the range of 85% to 97%, and the part other than the martensitic phase is composed of bainitic phase, which material has excellent strength and toughness.

EXAMPLE 3

To the Fe—Ni—Mo alloy powder of Sample No. 5 used in Example 1 were added Ni powder, Cu powder, and graphite powder in weight ratios as shown in Table 2, and they were mixed together for 30 minutes. The obtained admixtures were subjected to compacting at 600 MPa to form green compacts. The green compacts were then sintered at 1200° C. in dissociated ammonia gas for 60 minutes, and they were cooled at a rate of 10° C./min. Concerning the sintered products, the bending strengths and the impact values were measured.

For comparison purpose, a diffusion bonded powder (Sample No. 23) consisting of 4% Ni, 1.5% Cu, 0.5% Mo, and the remainder Fe was used for compacting and sintering under similar conditions and the determination of properties were done just like the above. By the way, after Sample No. 13 was cooled to a room temperature, it was heated again at 180° C. for 60 min. and properties were determined again as Sample No. 14. The results in the evaluations are shown in Table 2.

TABLE 2

| | Powder Composition (%) | | | C-Content after | Bending | Area Ratio of | |
|---|---|---|---|---|---|---|---|
| Sample No. | Ni Powder | Cu Powder | Graphite Powder | Sintering (%) | Strength (MPa) | Martensite (%) | Impact Value (J/cm$^2$) |
| 12 | 0 | 1 | 0.6 | 0.50 | 1255 | 47 | 12 |
| 13 | 2 | 1 | 0.6 | 0.50 | 1671 | 95 | 18 |
| 14 | 2 | 1 | 0.6 | 0.50 | 1809 | 95 | 20 |
| 15 | 4 | 1 | 0.6 | 0.50 | 1200 | 78 | 19 |
| 16 | 2 | 0 | 0.6 | 0.50 | 1272 | 83 | 16 |
| 17 | 2 | 3 | 0.6 | 0.50 | 1600 | 99 | 10 |
| 18 | 2 | 1 | 0.4 | 0.28 | 1558 | 85 | 19 |
| 19 | 2 | 1 | 0.3 | 0.18 | 1000 | 60 | 20 |
| 20 | 2 | 1 | 0.7 | 0.56 | 1569 | 90 | 19 |
| 21 | 2 | 1 | 0.8 | 0.66 | 1346 | 86 | 19 |

TABLE 2-continued

| Sample No. | Powder Composition (%) Ni Powder | Cu Powder | Graphite Powder | C-Content after Sintering (%) | Bending Strength (MPa) | Area Ratio of Martensite (%) | Impact Value ($J/cm^2$) |
|---|---|---|---|---|---|---|---|
| 22 | 2 | 1 | 0.9 | 0.74 | 993 | 68 | 20 |
| 23 | (*) | | 0.6 | 0.50 | 1132 | 40 | 27 |

Note:
Sample No. 14 was prepared by taking out the sintered sample No. 13 and it was then heated at 180° C.
(*): In Sample No. 23, diffusion bonded powder of Fe-4%Ni-0.5%Mo-1.5%Cu was used As is understood from the results in Table 2, when Ni-content is low, the area ratio of martensite decreases so that the strength is lowered. Furthermore, because the effect to suppress the brittleness with Cu is lowered, the impact value is lowered. On the contrary, when Ni-content is excess, the area ratio of austenitic phase increases with the lowering of strength.

When the content of Cu is low, the area ratio of martensite decreases with the lowering of strength. If the content of Cu is too high, the impact value is low.

When the C-content is low, the area ratio of martensite is low to form a perlitic phase, so that the strength becomes low. If C-content is too high, cementite precipitates in the grain boundary, so that the strength is also lowered. The sintered material prepared according to the present invention has higher bending strength and higher impact value as compared with those of the conventional ferrous sintered materials. In addition, when the material of the invention is heated again at 180° C., the mechanical properties thereof are much improved.

As described above, the method according to the present invention is suitable for producing a ferrous sintered alloy having a specific quenched structure. The method comprises the steps of preparing a powder by incorporating specified quantities of Ni powder, Cu powder, and graphite powder with a ferrous alloy powder containing Ni band Mo of a specific composition, compacting the obtained mixture to form green compacts, sintering the green compact at a temperature in the range of 1130° to 1230° C., and then cooling the obtained sintered product in a sintering furnace at a specified cooling rate, thereby forming a ferrous sintered alloy having a quenched structure. The ferrous sintered alloy of the invention has good compressibility and excellent mechanical strength without applying any specific quench-hardening step.

Accordingly, there is an advantage to produce a variety of mechanical elements at low cost and the field of uses of the sintered material can be enlarged.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive of the invention.

What is claimed is:

1. A method for producing a ferrous sintered alloy having a quenched structure in which, in area ratio of the micro structure excluding the area of pores, the martensitic phase is 85% to 97% and the remainder part is a bainitic phase, and which comprises the steps of:

preparing a powder mixture by adding, in weight ratios, 1 to 2% of copper powder, 1 to 3% of Ni powder, and graphite to an alloy powder of a composition consisting of 3 to 5% of Ni, 0.4 to 0.7% of Mo, and the remainder Fe, the amount of said graphite being such that the C-content after sintering is 0.2 to 0.7%; subjecting the obtained powder mixture to compacting in a tool to form a green compact; sintering said green compact in a non-oxidizing atmosphere at a temperature within the range of 1130° to 1230° C.; and cooling said sintered product in the sintering furnace at a rate in the range of 5° C./min. to 20° C./min.

2. A method for producing a ferrous sintered alloy as claimed in claim 1, wherein said product after the sintering step is cooled to 100° C. or below, and then the cooled product is heated again to a temperature of 150° C. to 300° C. and maintained at that temperature.

3. A method for producing a ferrous sintered alloy as claimed in claim 1, said cooling step is followed by the step to maintain the sintered product at a temperature in the range of 150° C. to 300° C.

* * * * *